US005513884A

United States Patent [19]

Bucher

[11] Patent Number: 5,513,884

[45] Date of Patent: May 7, 1996

[54] GOLF BALL RETRIEVING DEVICE

[76] Inventor: Betty A. Bucher, 9802 Gerald Dr., St. Louis, Mo. 63128

[21] Appl. No.: 488,967

[22] Filed: Jun. 8, 1995

[51] Int. Cl.[6] ..... A63B 47/02

[52] U.S. Cl. ..... 294/19.2

[58] Field of Search ..... 294/1.1, 1.3–1.5, 294/19.2, 55, 66.1; 43/7, 11, 12; 210/470, 471; 15/257.1, 257.9; 273/32 F, 162 E

[56] References Cited

U.S. PATENT DOCUMENTS

| | | | |
|---|---|---|---|
| 1,659,482 | 2/1928 | Dennemark | 294/19.2 |
| 1,723,709 | 8/1929 | Reiser | 294/19.2 |
| 2,604,715 | 7/1952 | Brown, Jr. | 43/11 |
| 3,141,696 | 7/1964 | Nau | 294/19.2 |
| 3,520,569 | 7/1970 | Anderson | 294/19.2 |
| 3,659,891 | 5/1972 | Pettenon et al. | 294/55 |
| 3,663,049 | 5/1972 | James | 294/19.2 |
| 4,509,751 | 4/1985 | Tabet | 294/19.2 |
| 4,635,987 | 1/1987 | Hurtgam | 294/19.2 |
| 4,799,725 | 1/1989 | Anderson | 294/19.2 |
| 4,822,087 | 4/1989 | DeCarlo | 43/11 |
| 5,368,350 | 11/1994 | Ader et al. | 294/19.2 |

FOREIGN PATENT DOCUMENTS

| | | | |
|---|---|---|---|
| 786-951 | 12/1980 | U.S.S.R. | 43/7 |

*Primary Examiner*—Dean Kramer

[57] ABSTRACT

A golf ball retrieving device for retrieving a golf ball by an individual residing within a moving golf cart. The inventive device includes a handle assembly supporting a basket frame at a lower end thereof. A mesh basket is attached to the basket frame and captures a golf ball received therethrough.

1 Claim, 3 Drawing Sheets

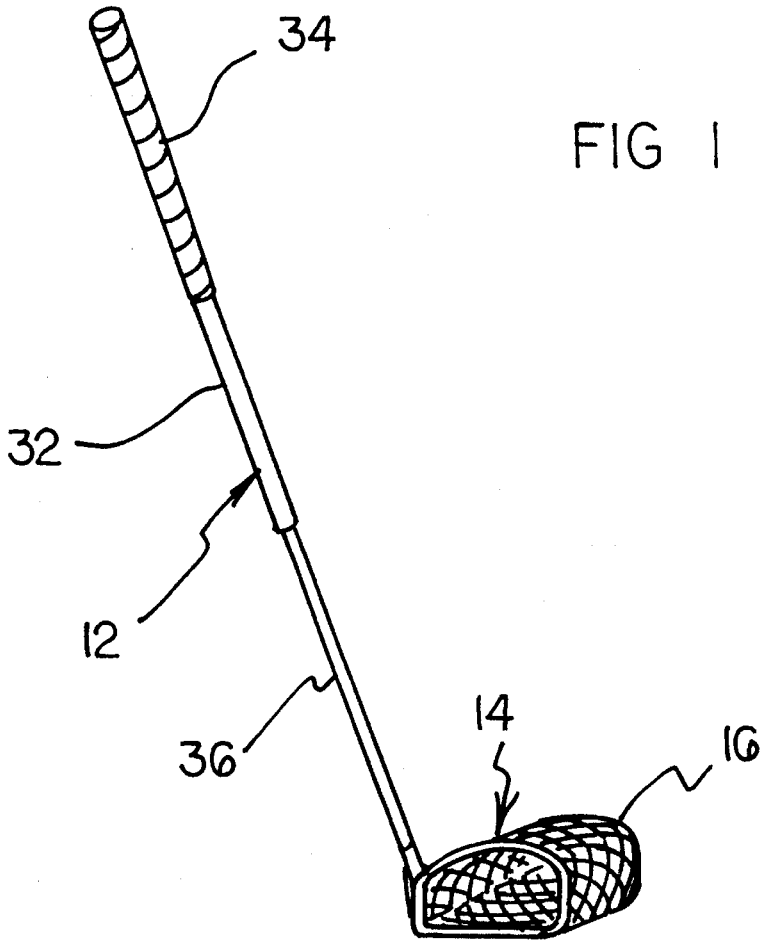
FIG 1
FIG 2
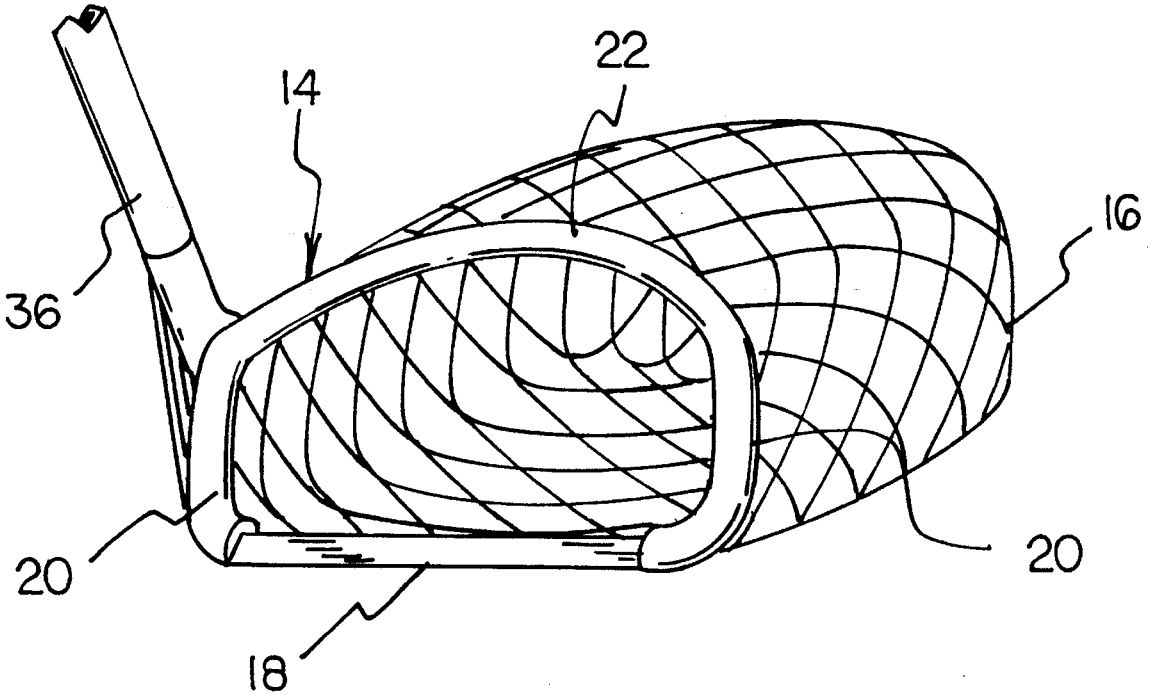

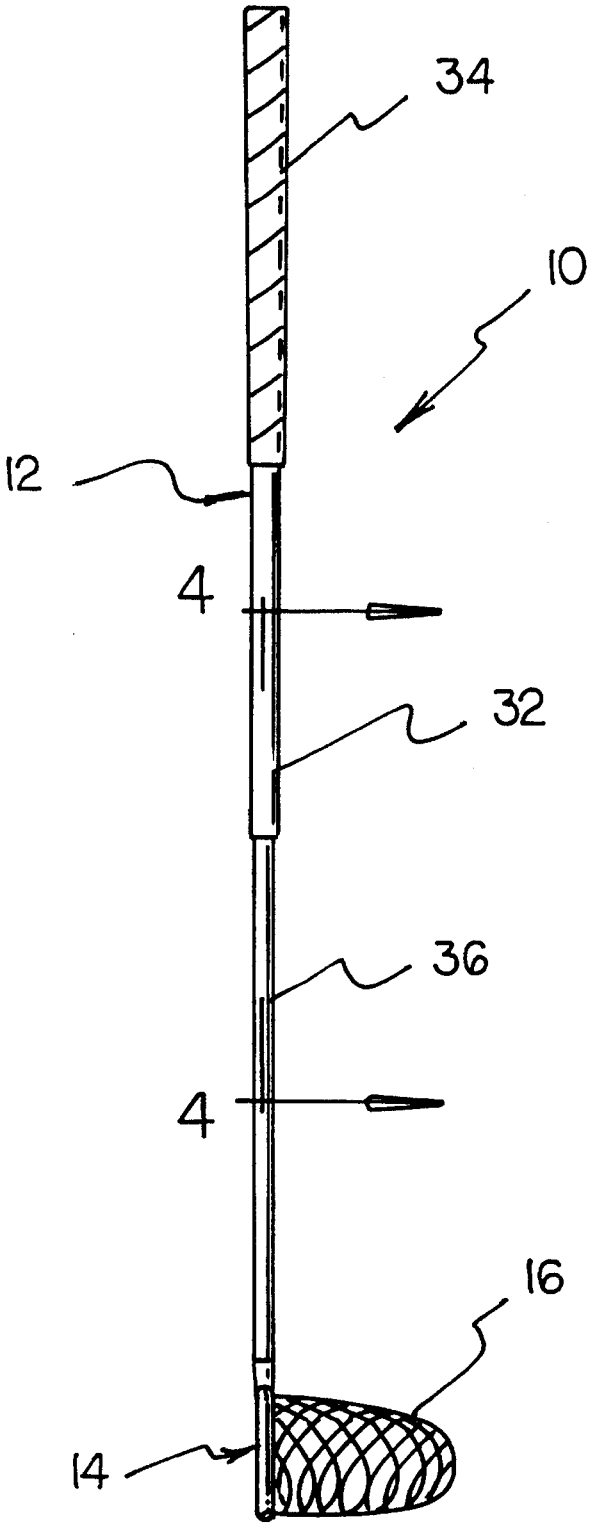
FIG 3
FIG 4
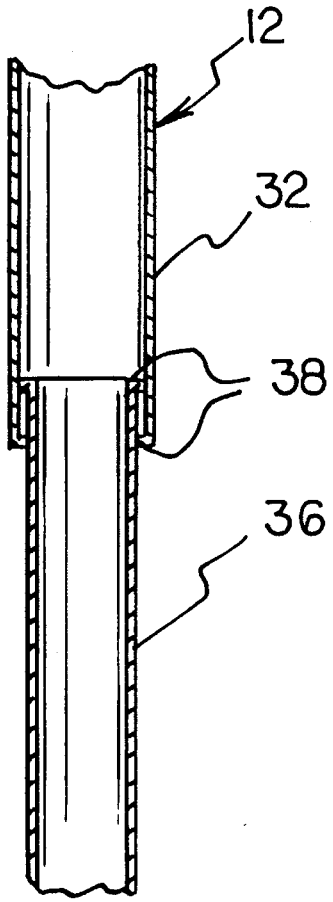

FIG 5
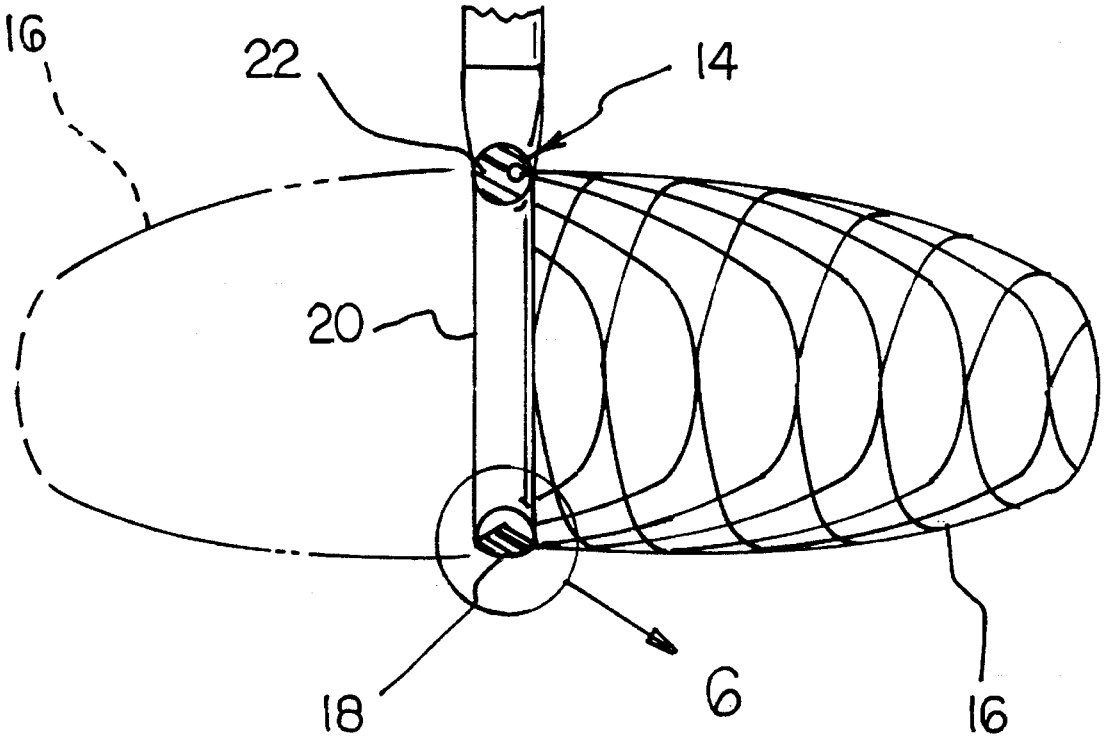
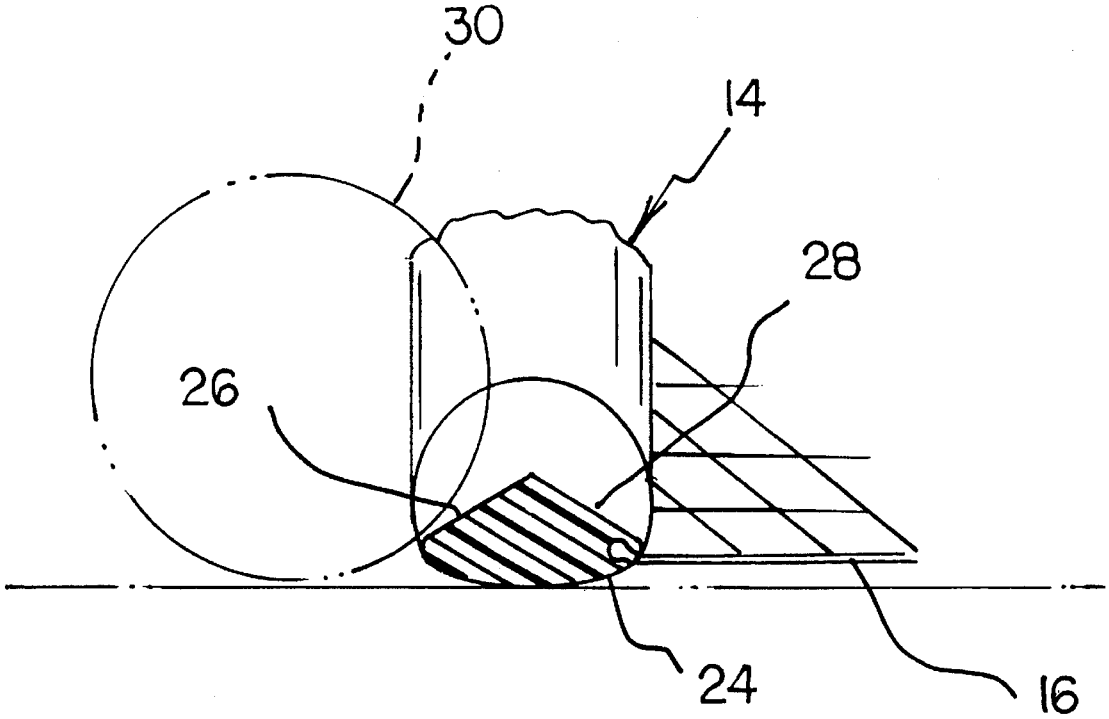
FIG 6

GOLF BALL RETRIEVING DEVICE

BACKGROUND OF THE INVENTION

1. Field of the Invention

The present invention relates to golf ball handling structures and more particularly pertains to a golf ball retrieving device for retrieving a golf ball by an individual residing within a moving golf cart.

2. Description of the Prior Art

The use of golf ball handling structures is known in the prior art. More specifically, golf ball handling structures heretofore devised and utilized are known to consist basically of familiar, expected and obvious structural configurations, notwithstanding the myriad of designs encompassed by the crowded prior art which have been developed for the fulfillment of countless objectives and requirements.

Known prior art golf ball handling structures include U.S. Pat. No. 5,326,145; U.S. Pat. No. 5,303,967: U.S. Pat. No. 5,277,466; U.S. Pat. No. 5,265,926; U.S. Pat. No. 5,246,260 U.S. Pat. No. 266,264.

While these devices fulfill their respective, particular objectives and requirements, the aforementioned patents do not disclose a golf ball retrieving device for retrieving a golf ball by an individual residing within a moving golf cart which includes a handle assembly supporting a basket frame at a lower end thereof, and a mesh basket attached to the basket frame and operable to capture a golf ball received therethrough.

In these respects, the golf ball retrieving device according to the present invention substantially departs from the conventional concepts and designs of the prior art, and in so doing provides an apparatus primarily developed for the purpose of retrieving a golf ball by an individual residing within a moving golf cart.

SUMMARY OF THE INVENTION

In view of the foregoing disadvantages inherent in the known types of golf ball handling structures now present in the prior art, the present invention provides a new golf ball retrieving device construction wherein the same can be utilized for remotely retrieving a golf ball. As such the general purpose of the present invention, which will be described subsequently in greater detail, is to provide a new golf ball retrieving device apparatus and method which has many of the advantages of the golf ball handling structures mentioned heretofore and many novel features that result in a golf ball retrieving device which is not anticipated, rendered obvious, suggested, or even implied by any of the prior art golf ball handling structures, either alone or in any combination thereof.

To attain this, the present invention generally comprises a golf ball retrieving device for retrieving a golf ball by an individual residing within a moving golf cart. The inventive device includes a handle assembly supporting a basket frame at a lower end thereof. A mesh basket is attached to the basket frame and captures a golf ball received therethrough.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new golf ball retrieving device apparatus and method which has many of the advantages of the golf ball handling structures mentioned heretofore and many novel features that result in a golf ball retrieving device which is not anticipated, rendered obvious, suggested, or even implied by any of the prior art tool guides, either alone or in any combination thereof.

It is another object of the present invention to provide a new golf ball retrieving device which may be easily and efficiently manufactured and marketed.

It is a further object of the present invention to provide a new golf ball retrieving device which is of a durable and reliable construction.

An even further object of the present invention is to provide a new golf ball retrieving device which is susceptible of a low cost of manufacture with regard to both materials and labor, and which accordingly is then susceptible of low prices of sale to the consuming public, thereby making such golf ball retrieving devices economically available to the buying public.

Still yet another object of the present invention is to provide a new golf ball retrieving device which provides in the apparatuses and methods of the prior art some of the advantages thereof, while simultaneously overcoming some of the disadvantages normally associated therewith.

Still another object of the present invention is to provide a new golf ball retrieving device for retrieving a golf ball by an individual residing within a moving golf cart.

Yet another object of the present invention is to provide a new golf ball retrieving device which includes a handle assembly supporting a basket frame at a lower end thereof, and a mesh basket attached to the basket frame and operable to capture a golf ball received therethrough.

These together with other objects of the invention, along with the various features of novelty which characterize the invention, are pointed out with particularity in the claims annexed to and forming a part of this disclosure. For a better understanding of the invention, its operating advantages and the specific object attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an isometric illustration of a golf ball retrieving device according to the present invention.

FIG. 2 is an enlarged isometric illustration of a portion of the present invention.

FIG. 3 is a front elevation thereof.

FIG. 4 is a cross sectional view taken along line 4—4 of FIG. 3.

FIG. 5 is a cross sectional view of a portion of the present invention.

FIG. 6 is an enlarged cross sectional view of the area set forth in FIG. 5.

DESCRIPTION OF THE PREFERRED EMBODIMENT

With reference now to the drawings and in particular to FIGS. 1–6 thereof, a golf ball retrieving device embodying the principles and concepts of the present invention and generally designated by the reference numeral 10 will be described.

More specifically, it will be noted that the golf ball retrieving device 10 comprises a handle means 12 for being grasped and manipulated by an individual during use of the device 10. A basket frame 14 is grasped to a lower end of the handle means 12 and supports a flexible mesh basket 16 in an open configuration for reception of a golf ball therewithin. By this structure, the present invention 10 can be extended from a moving golf cart and positioned proximal to a ground surface so as to capture a golf ball within the flexible mesh basket 16 during continuous movement of the golf cart.

As best illustrated in FIGS. 2. 5, and 6, it can be shown that the basket frame 14 preferably comprises a substantially straight base member 18 coupled relative to a lower end of the handle means 12 and oriented so as to extend at an oblique angle relative to a longitudinal axis of the handle means. Lateral members 20 project substantially orthogonally upward from opposed ends of the base member 18 and integrally continue into an arcuate upper member 22 extending between the upper ends of the lateral members 20 as shown in FIG. 2 of the drawings. The flexible mesh basket 16 is shaped so as to define an open end spaced from a closed end, with the open end thereof being secured to the members 18–22 of the basket frame 14. By this structure, the basket frame 14 positions the open end of the flexible mesh basket 16 into the open configuration illustrated in FIGS. 1 and 2 for reception of a golf ball therein.

As shown in FIGS. 5 and 6, the base member 18 of the basket frame 14 is desirably shaped so as to define an arcuate ground engaging surface 24 having an angled leading surface 26 projecting upwardly from a forward end of the arcuate ground engaging surface 24 and oriented so as to extend at an acute included angular orientation relative thereto. Similarly, an angled trailing surface 28 projects from a second trailing edge of the arcuate ground engaging surface 24 and is oriented so as to extend at an acute included angular orientation relative thereto. The angled trailing surface 28 intersects the angled leading surface 26 to define an unlabeled apex of the interior surface of the base member 18. By this structure, a golf ball 30 entering the mesh basket 16 through the basket frame 14 engages the angled leading surface 26 and is thereby projected into the mesh basket 16. The angled trailing surface 28 permits ease of egress of the golf ball 30 from the mesh basket 16 subsequent to retrieval of the golf ball. As shown by the phantom illustration in FIG. 5, the mesh basket 16 can be reversed to facilitate use of the device from either side of a moving golf cart.

As shown in FIGS. 1, 3, and 4, it can be shown that the handle means 12 of the present invention 10 preferably comprises an elongated handle tube 32 having a handle grip 34 secured to a first end thereof. A telescoping tube 36 is slidably received within a second end of the handle tube 32 and can be selectively extended therefrom as desired by an user. As shown in FIG. 4, the handle tube 32 and the telescoping tube 36 include abutting stop projections 38 which preclude unintentional separation or telescoping extension of the telescoping tube 36 from the handle tube 32. By this structure, the device 10 can be compacted by positioning the telescoping tube 36 into the handle tube 32 as desired for storage and/or transportation purposes.

In use, the golf ball retrieving device 10 according the present invention can be easily utilized to effect retrieval of a golf ball from a moving golf cart. The present invention 10 serves to eliminate stopping of the golf cart, exiting of an individual from the golf cart for manual retrieval of a golf ball residing upon an adjacent ground surface, and entrance of the individual back into a golf cart, thereby substantially speeding play of an associated golf game.

As to a further discussion of the manner of usage and operation of present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A golf ball retrieving device comprising:

a handle means for being grasped and manipulated by an individual, the handle means comprising an elongated handle tube having handle grip, secured to a first end thereof, a telescoping tube slidably received within a second end of the handle tube which can be selectively extended therefrom, and abutting stop projections coupled to both the handle tube and the telescoping tube which preclude unintentional separating extension of the telescoping tube from the handle tube;

a flexible mesh basket;

a basket frame coupled to a lower end of the handle means and supporting the flexible mesh basket in an open configuration for reception of a golf ball therein, the basket frame comprising a substantially straight base member coupled relative to a lower end of the handle means and oriented so as to extend at an oblique angle relative to a longitudinal axis of the handle means, the basket frame being further shaped so as to define an angled trailing surface projecting from a second trailing edge of the arcuate ground engaging surface and being oriented so as to extend at an acute including angular orientation relative thereto, the angled trailing surface of the base member of the basket frame intersecting the angled leading surface to define an apex of the interior surface of the base member such that a golf ball entering the mesh basket through the basket frame engages the angled leading surface and is thereby projected into the mesh basket over the angled trailing surface, lateral members projecting substantially orthogonally upward from opposed ends of the base member and an arcuate upper member extending between upper ends of the lateral members, with the flexible mesh basket being shaped so as to define an open end spaced from a closed end, with the open end thereof being secured to the members of the basket frame.

* * * * *